US006725745B1

(12) United States Patent
Palmieri

(10) Patent No.: US 6,725,745 B1
(45) Date of Patent: Apr. 27, 2004

(54) SAFETY FUSE TOOL

(76) Inventor: Brian A Palmieri, P.O. Box 789, Swansea, SC (US) 29160

( * ) Notice: Subject to any disclaimer, the term of this patent is extended or adjusted under 35 U.S.C. 154(b) by 0 days.

(21) Appl. No.: 10/156,354

(22) Filed: May 28, 2002

(51) Int. Cl.[7] ..... B25B 23/16
(52) U.S. Cl. ..... 81/53.1; 81/3.8
(58) Field of Search ..... 81/53.1, 53.11, 81/53.12, 3.8

(56) References Cited

U.S. PATENT DOCUMENTS

| | | | | | |
|---|---|---|---|---|---|
| 2,316,428 | A | | 4/1943 | Heinrich | |
| 3,666,311 | A | * | 5/1972 | McMullin | 29/750 |
| 3,788,691 | A | * | 1/1974 | McMullin | 29/750 |
| 3,840,969 | A | | 10/1974 | Landis | |
| RE28,709 | E | | 2/1976 | Crook, Jr. | |
| 4,077,661 | A | | 3/1978 | Inahashi | |
| 4,450,425 | A | | 5/1984 | Manning | |
| 4,582,352 | A | * | 4/1986 | Filter et al. | 294/19.1 |
| 5,178,427 | A | | 1/1993 | Jorritsma | |
| 5,292,165 | A | | 3/1994 | Wiklund | |
| 5,451,730 | A | | 9/1995 | Phillips, Sr. | |
| 5,532,668 | A | * | 7/1996 | Fennell | 337/168 |
| 5,564,852 | A | | 10/1996 | Maxwell et al. | |
| 5,670,927 | A | * | 9/1997 | Fennell | 337/168 |
| 5,742,220 | A | * | 4/1998 | Scherer | 337/171 |
| 6,474,197 | B1 | * | 11/2002 | Browen et al. | 81/3.8 |
| 6,512,442 | B1 | * | 1/2003 | Taylor | 337/171 |
| 6,518,871 | B2 | * | 2/2003 | Fennell | 337/171 |

OTHER PUBLICATIONS

Information available on the Reliable Equipment & Tool Service, Inc. website, at http://www.reliable–equip.com/ .The pdf format online catalog at pp. 94, 95, and 98 shows various hot sticks and disconnect hooks, which are referenced under the key word Epoxiglas® hot stick, clamp stick. The associated catalog pages accompanying this document were printed on Sep. 2001. The website contains the following copyright notice: Copyright © Reliable Equipment—2002.

Information available on the Hastings Fiber Glass Products website, at http://www.hfgp.com/ shows various hot stick heads, and disconnect hooks and heads. The associated website page accompanying this document was printed on Sep. 2001. The website contains the following copyright notice: Copyright © 2000 Hastings Fiber Glass Products Inc.

* cited by examiner

*Primary Examiner*—Lee D. Wilson
*Assistant Examiner*—David B. Thomas
(74) *Attorney, Agent, or Firm*—Michael A Mann; Timothy J Sabouz; Nexsen Pruet, LLC

(57) ABSTRACT

The safety fuse tool is used for handling high-voltage fuses and their fuse carriers, i.e., fuse barrel assemblies, or other similar or related devices, and can generally be described as having a central base structure carrying a movable head assembly and also carrying a pivotally mounted latch that is preferably comprised of two arms that work together operationally. The head assembly has at least one carrying arm and possibly a hook for servicing fuses and other related devices. A feature of the safety fuse tool is its automatic latching mechanism. This mechanism is essentially comprised of, among other items, a novel design of sliding surfaces that allows the head assembly and the latch to work together to automatically secure a fuse barrel assembly to the safety fuse tool.

20 Claims, 9 Drawing Sheets

SAFETY FUSE TOOL

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING, A TABLE, OR A COMPUTER, PROGRAM LISTING COMPACT DISK APPENDIX

Not Applicable.

BACKGROUND OF THE INVENTION

Generally, the present invention relates to tools used for handling power line fuses, fuse cutouts, and other similar components used on or with utility power lines, and more specifically, the present invention relates to the disconnect tools or hooks generally attached to or an integral part of insulated poles commonly referred to as "hot sticks" or "extendo sticks."

Single-phase and three-phase electrical power is delivered to commercial, industrial, and residential users through a system known as the power distribution grid, which generally includes such components as generating plants, transformers, and electrical power lines. These lines generally consist of both transmission lines, which typically have AC voltages in the range of about 70,000 to about 750,000 volts, and distribution lines, which typically have AC voltages in the range of about 2,300 to about 50,000 volts. Inevitably, there is an element of danger in working with these high voltages, yet there are many instances in which utility workers have to either service or repair these high voltage power lines in the performance of their duties. These service and repair duties often include the replacement of power line fuses, which, when operable, can carry hundreds of amps of electrical current and, even when inoperable, these fuses may be in an energized circuit carrying thousands of volts of electricity, which may still be available at the load side of the fuse.

Generally, power line fuses are located at or near the tops of power poles, which can place these fuses over 30 feet above the surface of the ground, and each fuse is generally carried in a fuse holder commonly referred to as a "fuse barrel assembly," which is used to provide an interface between the fuse and the fuse block, which is connected to the power line. Generally, the bottom end of the fuse barrel assembly has a hinge assembly that is comprised of an ejection assembly (for "automatically" releasing the top end of a blown fuse from a fuse block) and a pair of pivot pins (one pin on each side of the hinge assembly) that are adapted to fit into slots formed on the bottom of the fuse block—this bottom portion of the fuse block is commonly referred to as a "fuse block saddle." Generally, the top end of the fuse barrel assembly has a hoop, a pull-ring, or some other similar structure, and the hinge assembly has a slot, and both allow for the insertion of an arm (or bar) portion of a hot-line tool, or fuse tool, through the hoop or slot so that the fuse barrel assembly can be manipulated by the fuse tool. This manipulation or handling of the fuse barrel assembly includes, but is not limited to, carrying the fuse barrel assembly to and from the fuse block saddle, and inserting the top end of the fuse barrel assembly into (and/or removing the top end of the fuse barrel assembly from) the top end of the fuse block, which is commonly referred to as the "fuse block switch." Briefly stated, the insertion and removal of the fuse barrel assembly from the fuse block switch is accomplished by rotating the top end of the fuse barrel assembly about the pivot point defined by the pivot pins and the slots on the fuse block saddle. In other words, after the hinge assembly is properly seated in the fuse block saddle, the fuse barrel assembly is supported by the fuse block saddle and is free to be rotated about the pivot point. This allows the top end of the fuse barrel assembly to be rotated into the fuse block switch in order to insert the fuse into the electrical circuit that it is a part of, or alternatively the top end of the fuse barrel assembly can be rotated away from the fuse block switch to remove the fuse from its electrical circuit, in which case the fuse tool can be inserted through the hinge assembly slot and used to both lift the fuse barrel assembly from the fuse block saddle, and then carry the fuse barrel assembly to the ground for servicing or replacement.

Oftentimes these fuses have to be replaced during inclement weather conditions including heavy rains and high winds. Generally, the prior art tools used for replacing fuses are comprised of fittings attached to insulated extension poles. Many of these fittings have one or two prongs, arms, and/or hooks that are used for, among other functions, carrying and manipulating the fuse barrel assembly into, and/or out of, the fuse block. Many of these prior art tools, however, do not have a means for securing a fuse barrel assembly to the tool while being manipulated by the tool. This can lead to the extremely dangerous condition of the fuse barrel assembly becoming separated from the tool and hurtling a considerable distance to the ground causing serious personal injuries and significant property damage. Moreover, this dangerous condition becomes even more likely during inclement weather conditions.

Thus there remains a need for a fuse tool that can securely carry a fuse barrel assembly while the fuse barrel assembly is being handled by the tool.

SUMMARY OF THE INVENTION

According to its major aspects and briefly recited, the present invention is a tool used for handling high-voltage fuses and their fuse carriers, i.e., fuse barrel assemblies. This handling includes, but is not limited to, installing (and/or removing) a fuse barrel assembly into (and/or from) an electrical distribution (or transmission) system mounting, i.e., fuse block, in which it is used. Generally the safety fuse tool is comprised of a movable head assembly that preferably incorporates one or two arms, which, since there are a variety of fuse blocks, fuse carriers and mounting systems used in the field, may provide the tool with a greater degree of operational flexibility. The present safety fuse tool also is comprised of a latching mechanism that, in combination with the head assembly and/or arms, automatically secures a fuse barrel assembly to the safety fuse tool while the fuse barrel assembly is being handled by the safety fuse tool. On the other hand, however, it can be easily disengaged from the fuse barrel assembly when appropriate to do so.

A feature of this invention is the automatic latching mechanism, which provides the advantage of ease of use. This is especially beneficial in that the fuse barrel assembly (including the fuse) is often 30 feet or more above the ground, which generally requires the use of insulated extension poles that, due to this distance, are often cumbersome and difficult to handle and control. This also provides the additional advantage of not requiring a great deal of training on, or use of, the safety fuse tool prior to the user becoming proficiently skilled in its use.

Another feature of the present invention is the use of a carrying arm that is dimensioned to be longer than those used in the prior art, which provides safety as well as ease of use advantages.

Another feature of the present invention is the use of reflective and/or luminescent materials with the tool, which provides an improved nighttime usability for the tool.

Another feature of the present invention safety fuse tool is its incorporation of a universal connector that, without the need for modification to the safety fuse tool and/or extension poles, provides the user with the advantage of immediately being able to use the safety fuse tool with most of the insulated extension poles already being marketed and used in the field.

Another feature of the present invention safety fuse tool is the efficiency of its design, which provides the advantage of the safety fuse tool being economical to manufacture and use.

These and other features and their advantages will be apparent to those skilled in the art of electrical fuse handling tools from a careful reading of the Detailed Description of the Invention, accompanied by the drawings.

DETAILED DESCRIPTION OF THE INVENTION

The present invention is a fuse-handling tool that is an improvement over existing fuse tools by providing safety features not found in the prior art. Preferably, the safety fuse tool can be used to safely remove and replace electrical fuses and/or other related devices commonly used in electrical transmission and distribution systems that have become inoperable and in need of replacement in order to return the electrical system, in which the fuse or other related device is a part of, to normal operation. Generally these fuses (and other related devices) are each attached to carrier commonly referred to as a "fuse barrel assembly." Generally, fuse barrel assemblies (and these other related devices) have a ring-like or a handle-like structure, which provides a convenient means for using an arm or projection on a fuse-handling tool to manipulate the fuse barrel assembly (and/or these other related devices). Preferably, the present invention safety fuse tool also has at least one arm for insertion through the ring-like or handle-like structures so that the present invention can be used to handle the fuse (or other related devices), however, the present invention safety fuse tool also makes use of a novel latching mechanism that automatically secures the device being handled to the safety fuse tool until it is safely near the ground (at which time the device can be safely released from the safety fuse tool by the user).

Because of the functional and operational flexibility of the present invention, and because a fuse or fuse cartridge is generally carried within some type of holder such as a fuse barrel assembly, when used herein, the term "fuse," in any of its forms, is defined to include all types of fuses and fuse carriers, including, but not limited to, power fuses, cutout barrels, fuse barrels, fuse barrel assemblies, switch barrels and high-voltage fuses. Similarly, when used herein, the phrase "other related devices," in any of its forms, includes, but is not limited to, fuse cutouts, power interrupt switches, disconnects, and fuse limiters. In this regard and for simplicity, and when the context dictates, the terms "fuse," or "fuse barrel assembly" in any of their forms, as used herein should be construed to include not only fuses and fuse carriers, but other related devices as well, and they should also be construed as being interchangeable.

Figure 1:
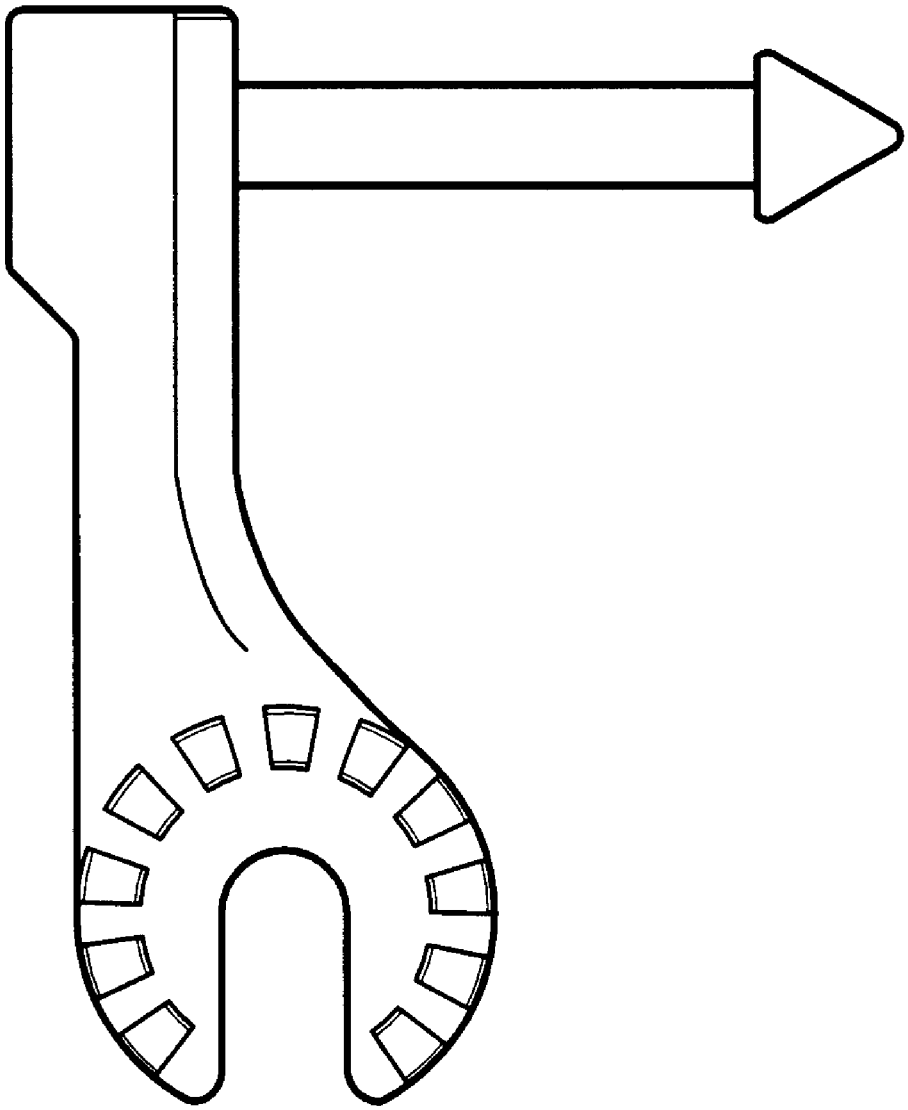
FIG. 1 PRIOR ART
FIG. 1 is an illustration of a prior art fuse removal tool.
Figures 2, 3A, 3B:
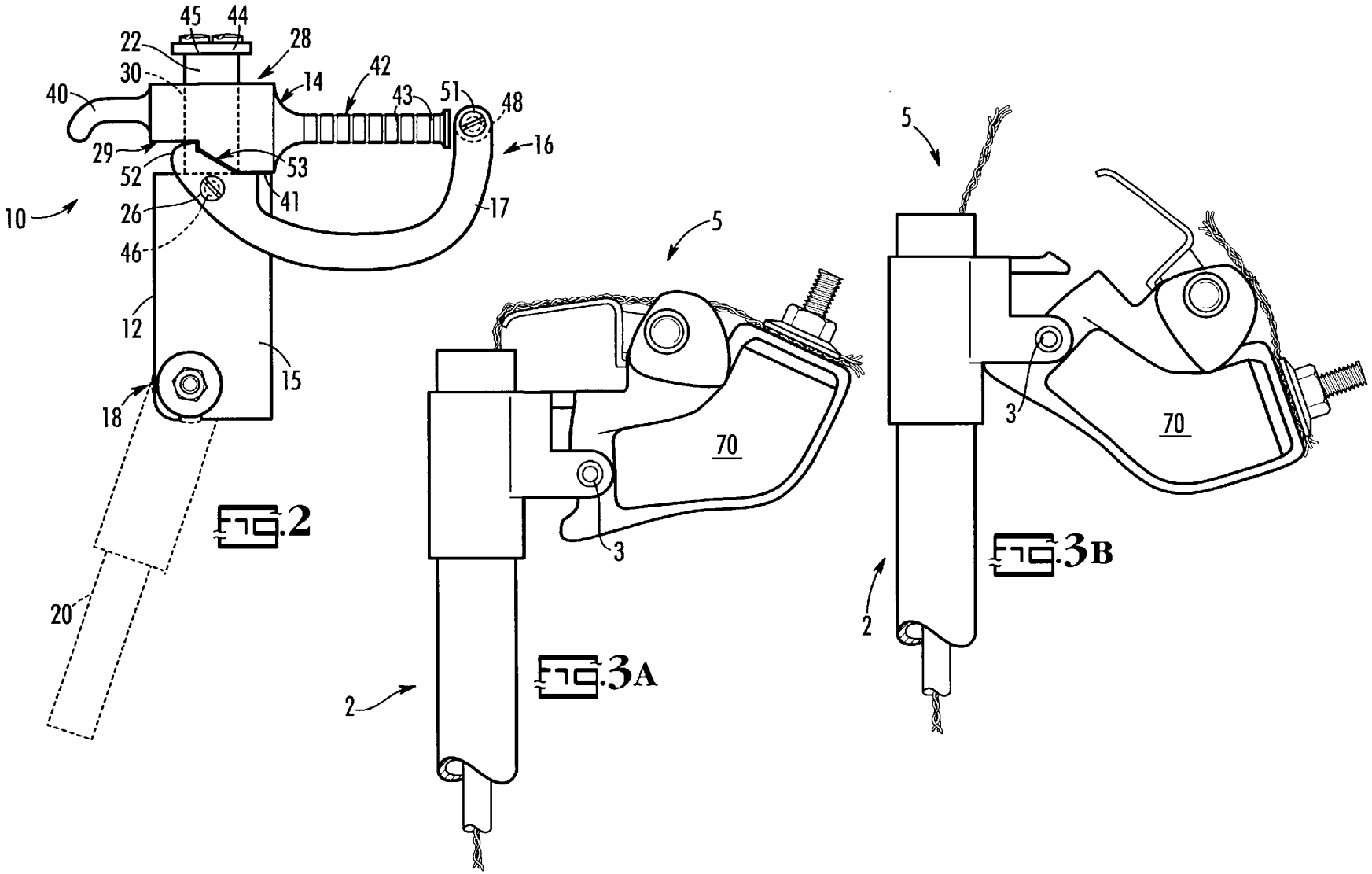
FIG. 2 is a right side view of the present invention safety fuse tool showing some of the differences between the present invention and the prior art, according to a preferred embodiment of the present invention.
FIG. 3A is a side view of the bottom end of a conventional fuse barrel assembly showing the orientation of a fuse slot on a "good" fuse.
FIG. 3B is a side view of the bottom end of a conventional fuse barrel assembly showing the orientation of a fuse slot on a "blown" fuse.

Referring now to the figures, FIG. 1 illustrates a prior art conventional fuse-handling tool configured with a single extension arm that, for example, can be used to release a fuse from its fuse block or mounting and then can be used to "carry" the released fuse to the ground. Since many of the prior art fuse-handling tools are generally similar in design to that shown in FIG. 1, it is not uncommon for a fuse barrel assembly, which may weigh over several pounds, to become separated from the prior art fuse-handling tool causing the fuse barrel assembly to hurtle toward the ground and land with a substantial amount of force, which can result in the infliction of serious personal injuries or a significant amount of property damage. This is compounded by the fact that many of the fuse barrel assemblies are carried in fuse blocks (i.e., mountings) 1 that are located 30 feet or more above the ground.

Referring now to FIGS. 2A–5B, the improved fuse tool or safety fuse tool is generally indicated by reference number 10 and it includes a base 12, a head assembly 14, and a latch 16. Preferably all of the major components 12, 14, and 16 of the safety fuse tool 10 are fabricated from any suitable thermoplastic, polymer, composite fibers, plastic or any other resin, or any other suitable material that after being used to fabricate the safety fuse tool 10 will possibly allow the safety fuse tool 10 to meet the following desired criteria: can be used safely; can reasonably withstand the wear-and-tear and other stresses associated with the safety fuse tool's 10 uses; and can meet the regulatory requirements placed on tools of this type, e.g., ANSI standards. Other suitable materials may include, but are not limited to, metallic or semi-metallic materials, including, but not limited to, aluminum, bronze, or alloys of aluminum and bronze. Similarly, and possibly in association with the selection of the materials used for fabricating the safety fuse tool 10, the components of the safety fuse tool 10 are dimensioned to possibly meet the same desired criteria.

Preferably the base 12 uses a swivel 18 for easy attachment of the safety fuse tool 10 to any of the commonly used insulated poles 20, e.g., hot-sticks or extendo sticks, and has a shaft (or rod) 22 extending from the top of the base 12. Also attached to the base 12 is a latch 16. Preferably the latch 16 is attached to the base 12 through the use of at least one pivot pin 26; however, any other suitable attachment means and/or fastener can be used as well including, but not limited to, partially threaded screws or bolts.

Another major component is the head assembly 14. The head assembly 14 has a body 28, and, preferably, a passage 30 formed through the body 28 from the top end 27 to the bottom end 29 of the body 28. The passage 30 is dimensioned to allow the insertion of the shaft 22 through the body 28 and, therefore, through the head assembly 14, and to allow the head assembly 14 and the shaft 22 to move relative to each other. Preferably the shaft 22 and the passage 30 are rectangular in shape; however, any other suitable shape that allows these components 22 and 30 to move relative to each other can be used as well including, but not limited to, a cylindrical or a triangular shape. Preferably, the relative movement between the shaft 22 and the head assembly 14 is constrained to a limited range of travel, and to the direction generally defined by the vertical axis 34 of the safety fuse tool's major dimension (with little, or no, twisting movement). Additionally, an upper travel stop 44 is also used to constrain the head assembly's 14 range of travel, and the design of the base 12, itself, provides a lower travel stop 41. The upper travel stop 44 can be a plate or flange, or it can be provided by flaring the top 45 of the shaft; however, the upper travel stop 44 is preferably a rectangular shaped plate that is securely attached to the top 45 of the shaft 22 through the use of at least one screw, pin, or any other suitable fastener or attachment means, including, but not limited to, gluing or welding. Preferably, the upper travel stop 44 is fabricated from the same material used to fabricate the major components 12, 14, and/or 16; however, any other suitable material can be used as well. Additionally, the latch 16, by itself, or in combination with some of the other safety fuse tool 10 components, may also be used to provide a lower and/or an upper travel stop function as well. Moreover, the bottom end 29 of the body 28 is formed to have a slanted portion 32 and a notch 33, which are used in combination with the latch 16 to securely carry, install, and/or remove a fuse barrel assembly 2 (and the fuse carried by the fuse barrel assembly 2) from a fuse block 1.

The head assembly 14 has at least one integrally attached arm, hook, bar and/or other structure, extending from the body 28. Preferably the fuse tool 10 has two extending structures incorporated onto the body 28 of the head assembly 14, with one of these being a carrying arm 42 and the other being a hook 40. These extending structures 40 and 42 are preferably fabricated of the same material used in fabricating the head assembly 14 and both are attached to the head body at about a 90 degree angle to the angle formed by the passage 30 (which is same angle formed by the vertical axis 34 of an assembled safety fuse tool 10) and, preferably, the carrying arm 42 extends away from the head body 28 in a direction that is opposite to that in which the hook 40 extends away from the head body 28, i.e., 180 degrees apart from each other. The tip end 57 of the carrying arm 42 is preferably flared; however, the carrying arm tip end 57 may be formed into any other suitable shape including, but not limited to, prong shaped or conical shaped. Additionally, the carrying arm 42 is preferably threaded or grooved 43 and the carrying arm 42 and/or any of the other parts of the safety fuse tool 10 preferably have a reflective, luminescent, or some other similar suitable light reflective and/or emissive material applied to their surfaces or incorporated into their fabricating materials in order to facilitate the use of the safety fuse tool 10 at night. Similarly, the body 28 is preferably etched, scribed, or otherwise has at least one visual indicator incorporated onto the body's 28 exterior surface (or into the body 28), which may also be associated with the use of a light reflective and/or emissive material as well. Moreover, with respect to the use of threads or grooves 43 on the carrying arm 42, besides providing a gripping characteristic the threads or grooves 43 will also provide protection for the light reflective and/or emissive material. While the preferred materials for fabricating the extending structures 40 and 42 and their positioning on the fuse tool 10 have been described, other suitable materials and/or placements can be used as well.

Preferably, the entire head assembly 14, as well as most of the other safety fuse tool 10 components, are preferably formed from blocks of material using CNC, or other suitable machining equipment and techniques. However, the components used in the safety fuse tool 10 can also be formed by forging, preferably by using a single cast for the head assembly 14 and a single cast for the base 12, or they can be formed by any other suitable fabrication method or technique appropriate for the material being used including, but not limited to, precision machining, or multiple castings, e.g., separate castings of the top of the body 28, the extending structures 40 and/or 42, the bottom of the body 28, and the base 12 (in which case the separately cast pieces can by welded together, have integral threads, or can be connected together by any other suitable method or means).

Figure 4B:
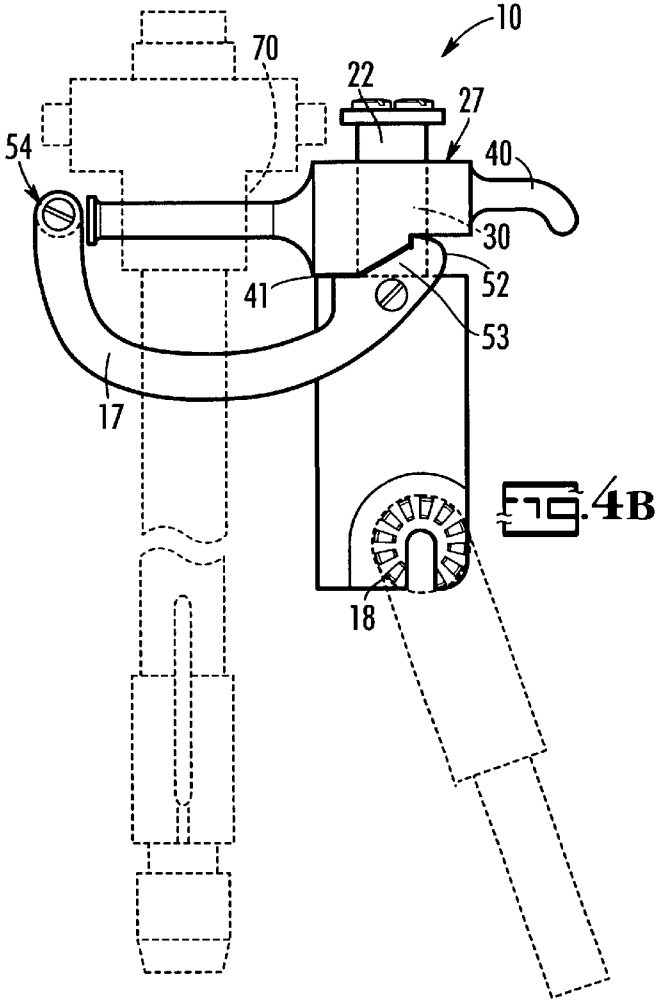
FIG. 4B is a left side view of the present invention showing the securing assembly in its "closed" position, with the fuse carrying arm inserted through the fuse slot of a fuse barrel assembly, according to a preferred embodiment of the present invention.
Figure 4A:
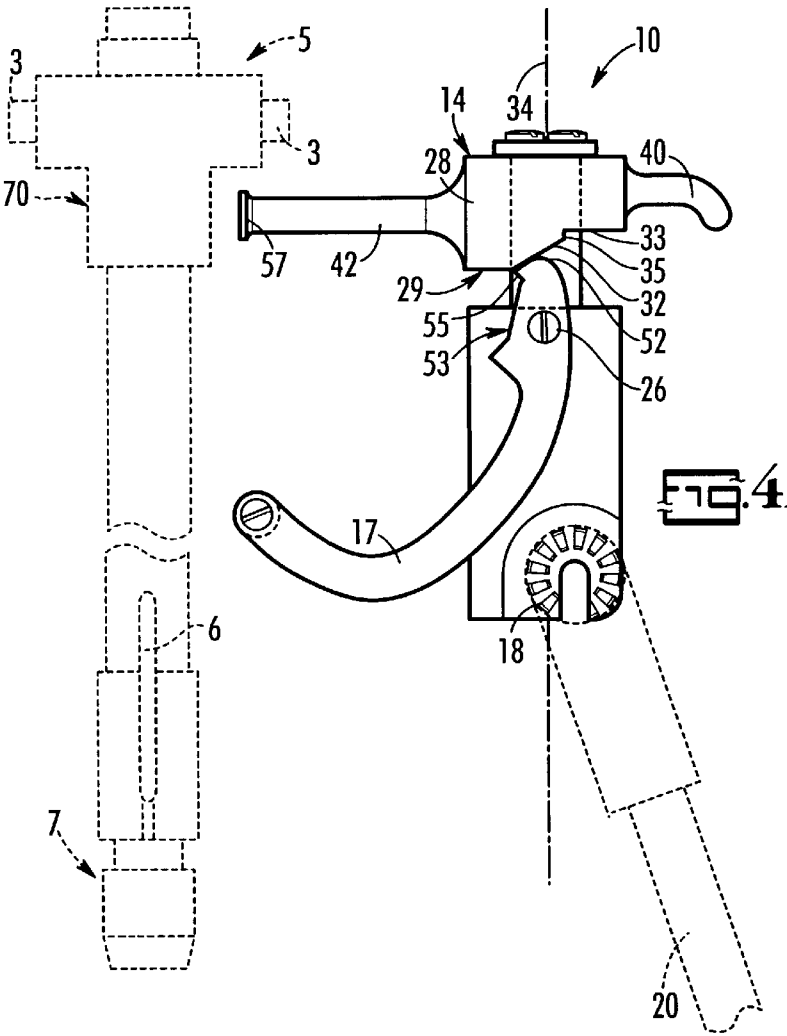
FIG. 4A is a left side view of the present invention showing the securing assembly in its "open" position, according to a preferred embodiment of the present invention.
Figure 5A:
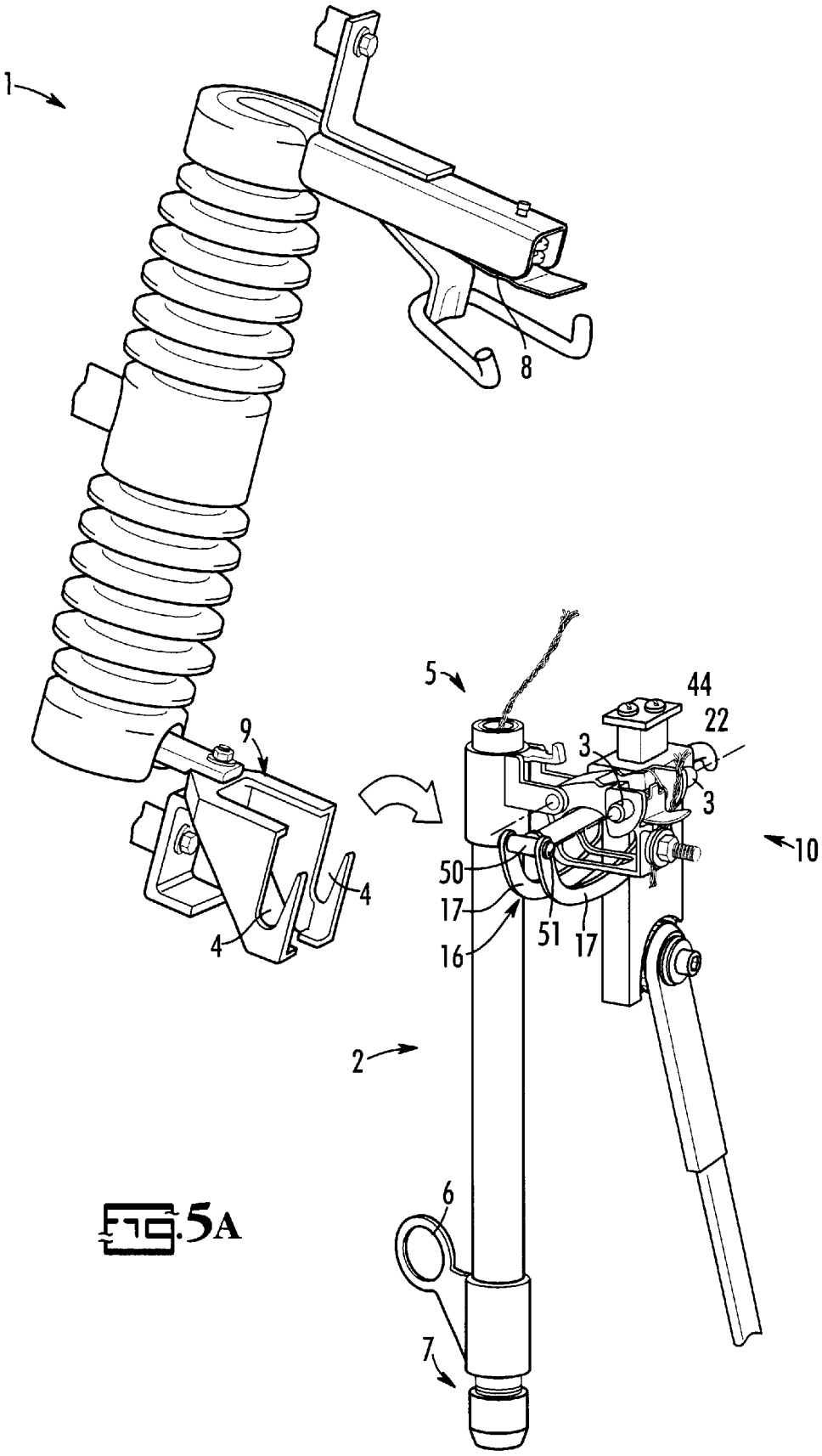
FIG. 5A is a front perspective view of the present invention safety fuse tool attached to an insulated extension pole, and showing a "blown" fuse being removed from a fuse block, according to a preferred embodiment of the present invention.
Figure 5B:
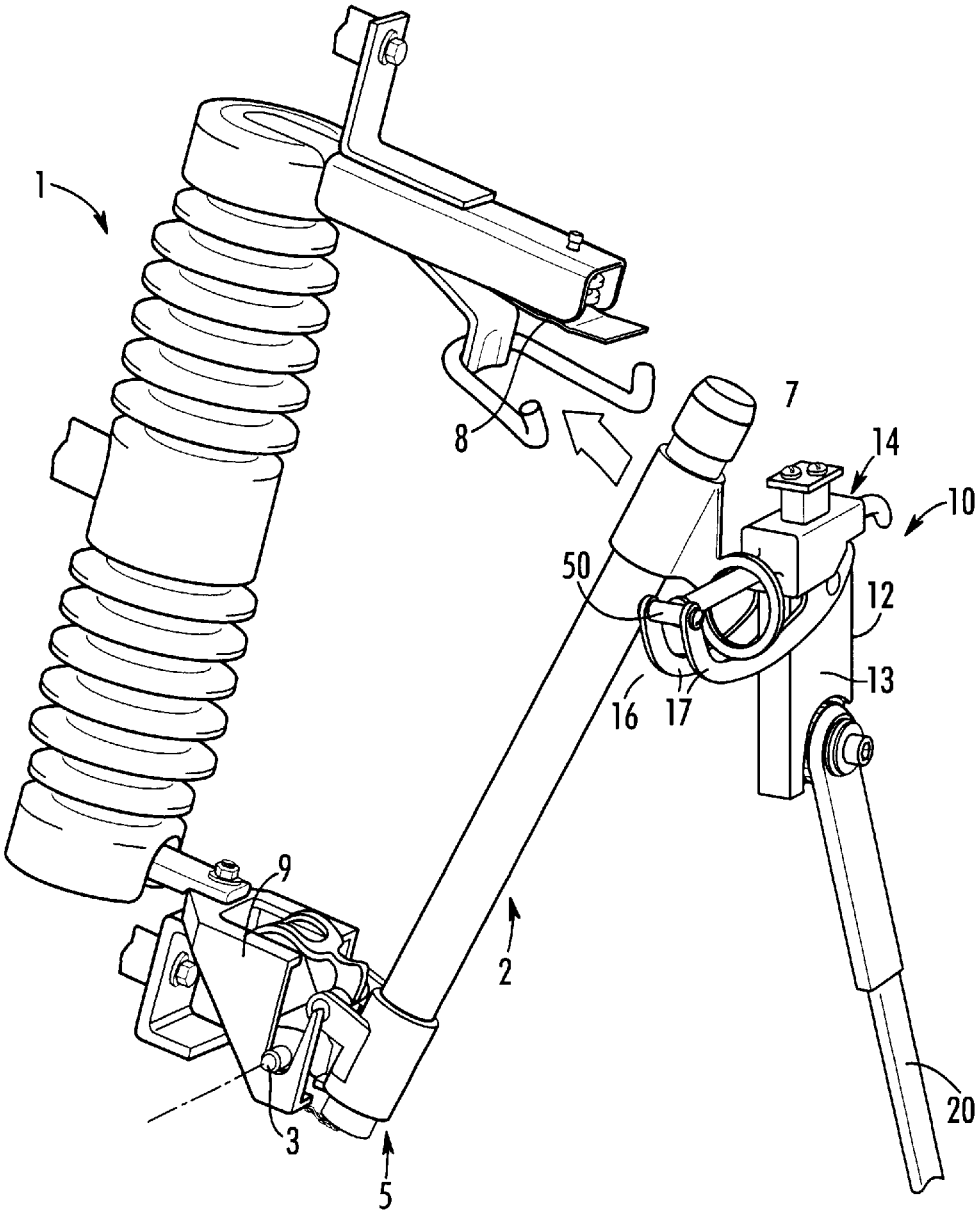
FIG. 5B is a front perspective view of the present invention safety fuse tool attached to an insulated extension pole and showing a "good" fuse being inserted into a fuse block switch, according to a preferred embodiment of the present invention.
Figure 6:
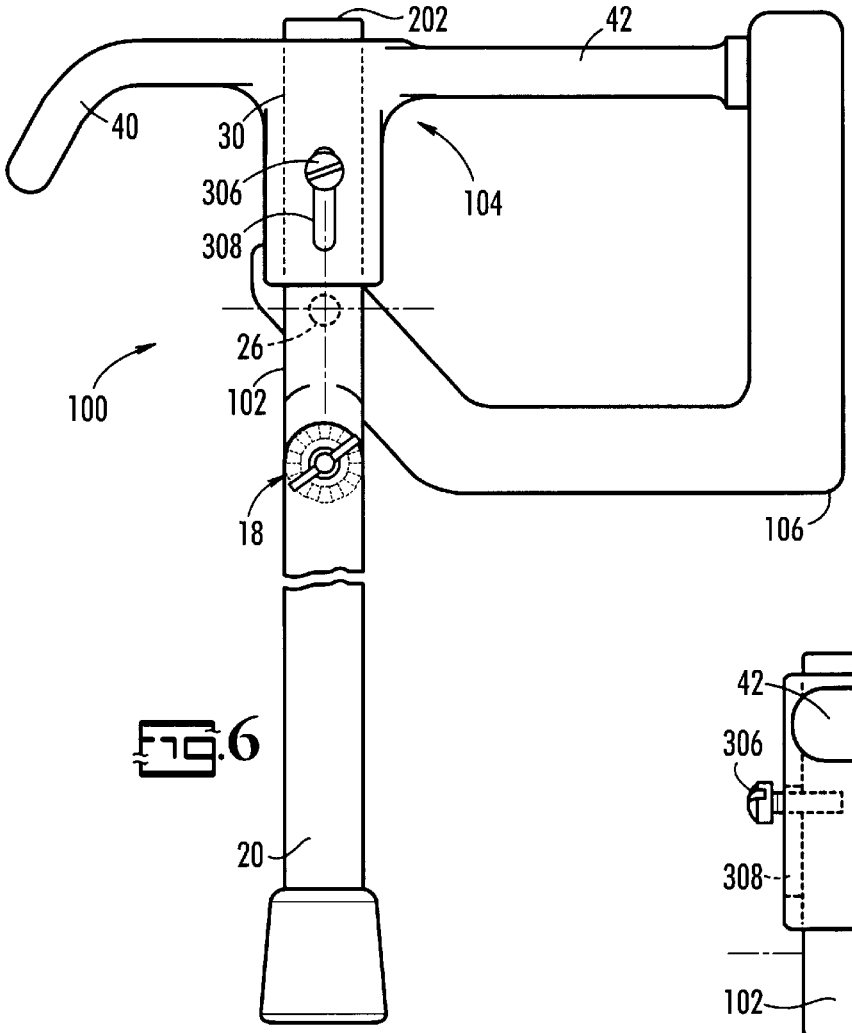
FIG. 6 is a right side view of the present invention safety fuse tool, according to another preferred embodiment of the present invention.
Figure 7:
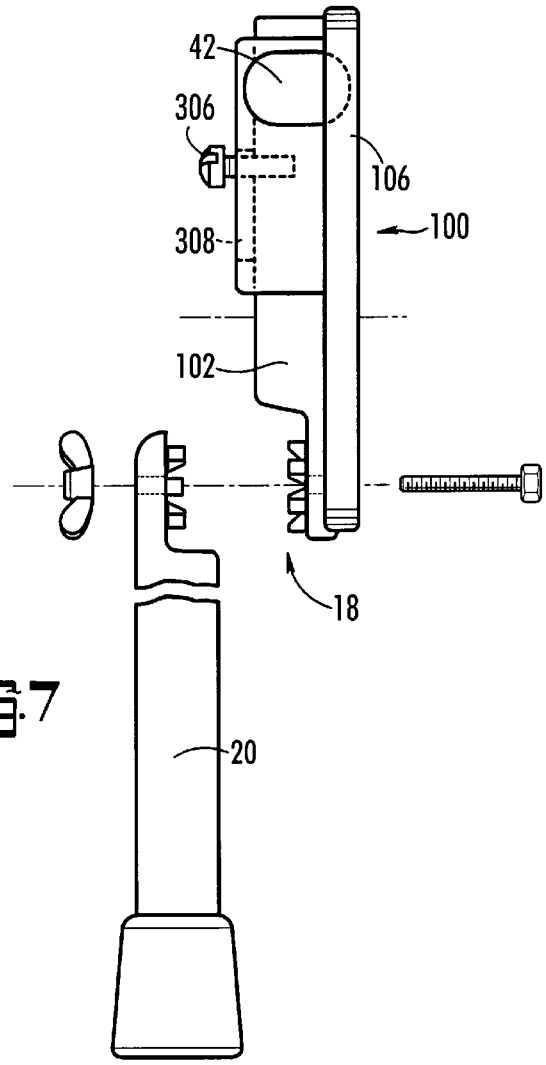
FIG. 7 is an exploded front view of the present invention safety fuse tool, according to the preferred embodiment of the present invention shown in FIG. 6.

Also attached to the base 12, as previously mentioned, is the latch 16. The latch 16 is preferably made from the same material used to fabricate the base 12 and/or the head assembly 14; however, any other suitable material can be used as well. As shown in FIGS. 4A and 4B, the latch 16 is preferably comprised of a pair of curved arms 17, with one arm being pivotally pinned to the left side of the base 12 and the other arm being pivotally pinned to the right side of the base 12. The pinning is accomplished through the use of at least one pivot pin 26, which is inserted through a pivot point aperture 46 formed on the cam end 52 of each arm 17. Also formed on the cam end 52 of each arm is a cutout portion 53, which has a lip 55 that is formed on one end of the cutout portion 53. The other end of each arm 17 is the latch tip end 54, which, preferably, has a tip end aperture 48 formed therethrough for receiving a pin, bolt, or any other suitable fastener 51 or attachment means for connecting the latch tip end 54 of each arm 17 together. Preferably, a spacer 50 having a passage formed therethrough for receiving the fastener 51 is used to keep the latch tip ends 54 of the arms 17 in a spaced apart relationship. The spacer 50 is preferably fabricated from a resilient material; however, the spacer 50 can be fabricated from any other suitable material including, but not limited to, a metallic or a hard plastic material.

Figure 8B:
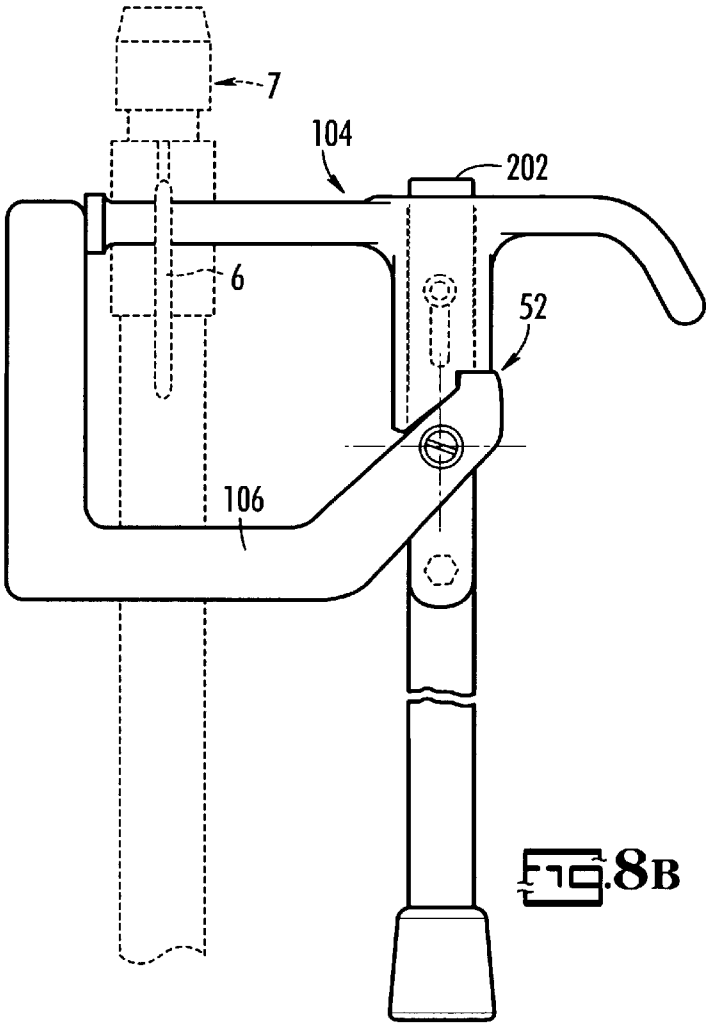
FIG. 8B is a left side view of the present invention showing the securing assembly in its "closed" position, with the fuse carrying arm inserted through the fuse ring of a fuse barrel assembly, according to the preferred embodiment of the present invention shown in FIG. 6.
Figure 8A:
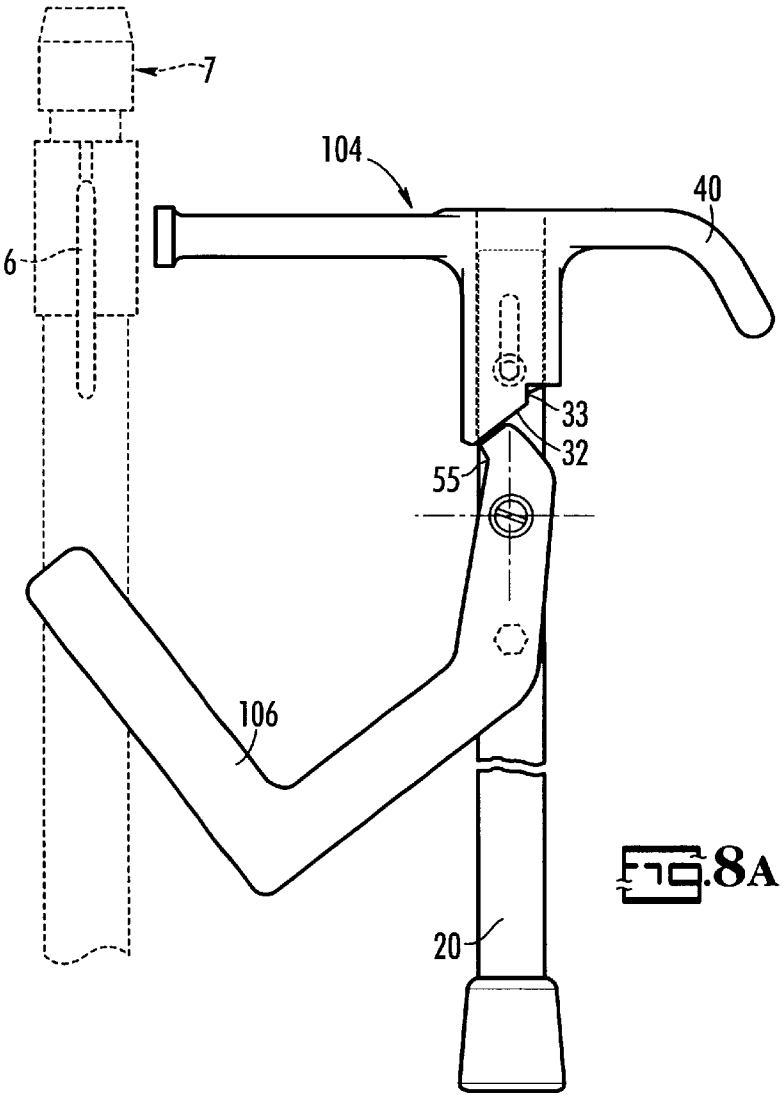
FIG. 8A is a left side view of the present invention showing the securing assembly in its "open" position, according to the preferred embodiment of the present invention shown in FIG. 6.
Figure 9A:
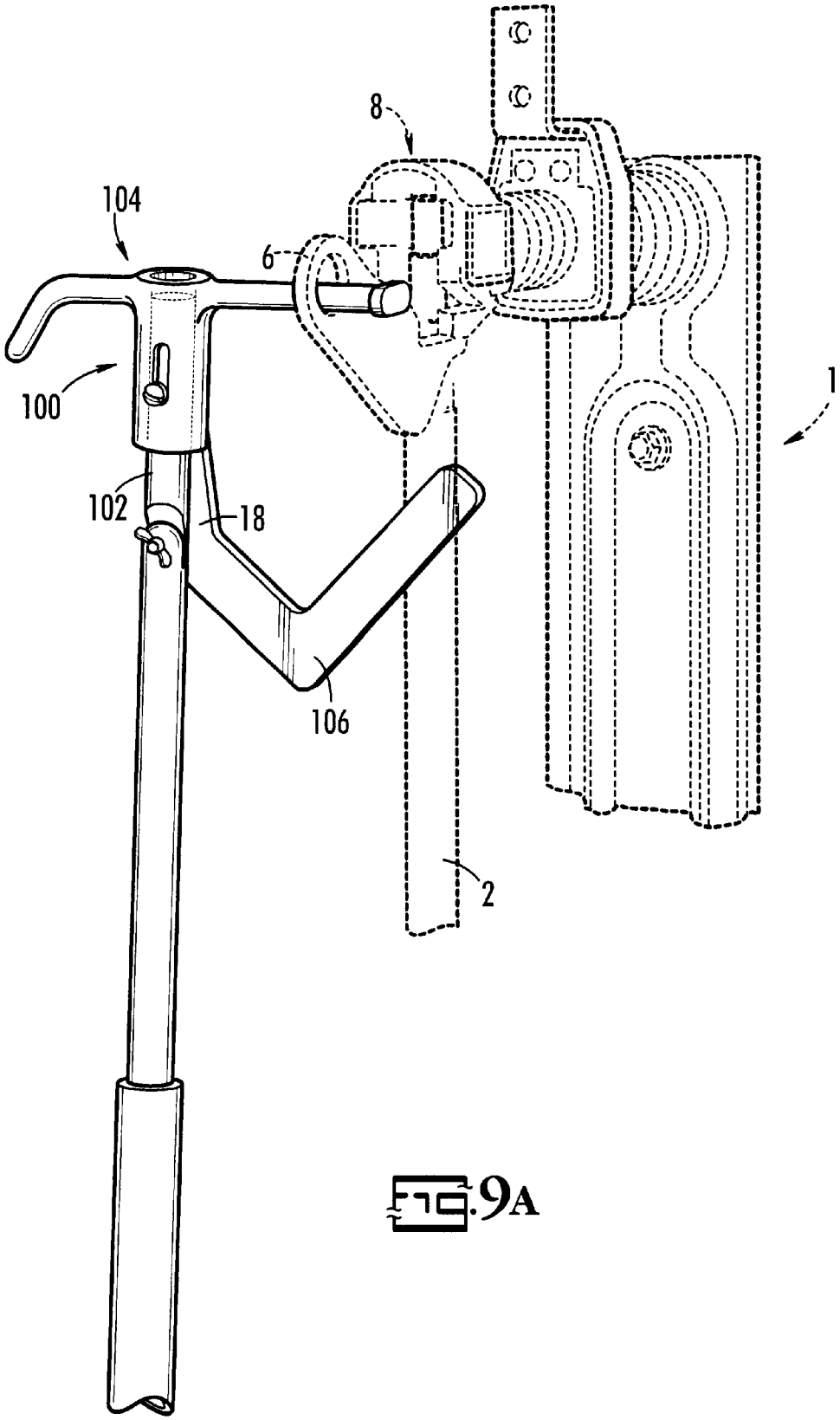
FIG. 9A is a front perspective view of the present invention safety fuse tool attached to an insulated extension pole and showing the present invention being prepared to remove a "blown" fuse from a fuse block, according to the preferred embodiment of the present invention shown in FIG. 6.
Figure 9B:
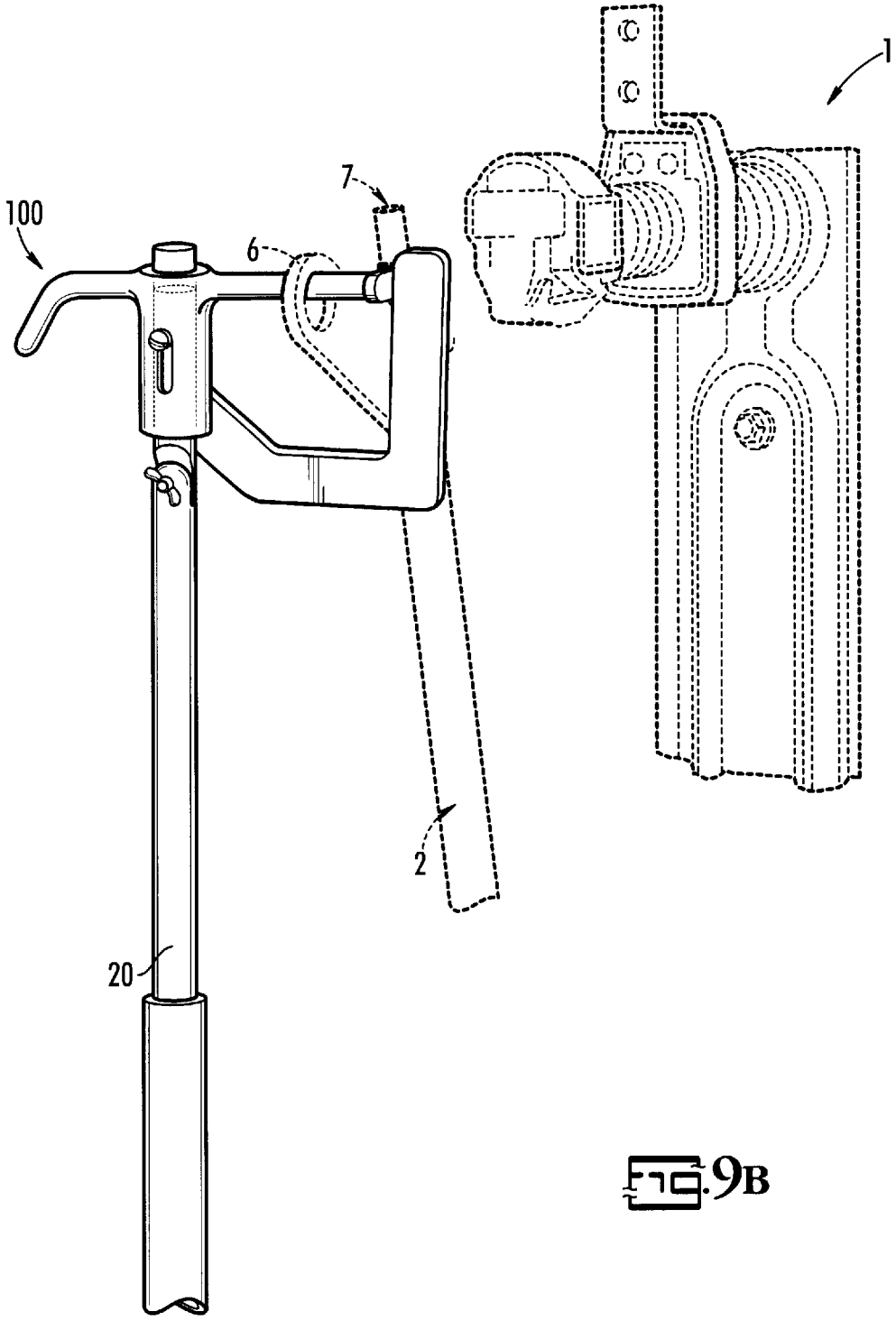
FIG. 9B is a front perspective view of the present invention safety fuse tool attached to an insulated extension pole and showing a fuse being removed (or inserted) into a fuse block switch, according to the preferred embodiment of the present invention shown in FIG. 6.

The pivot point aperture 46 and pivot pin 26 form a pivot point about which the latch 16 rotates, and in coordination with the movement of the head assembly 14, the rotational movement of the latch 16 and the (preferably, but not necessarily, linear) movement of the head assembly 14 position the latch 16 and the carrying arm 42 into and between an open position (as shown in FIGS. 4A, 8A and 9A) and a closed position (as shown in FIGS. 2, 4B, 5A–B, 8B and 9B). As shown in FIG. 4A, when the safety fuse tool 10 is in its open position the carrying arm tip end 57 and the latch tip end 54 are spaced apart from each other to the extent that the carrying arm 42 can be easily inserted through a fuse ring 6 or a fuse slot 70, and the preferably curved portion of the cam end 52 is in contact with the slanted portion 32 of the body 28 and is preferably supporting the body 28 and, therefore, the head assembly 14 in the head assembly's 14 open position.

With the safety fuse tool 10 attached to a hot-stick or some other insulated pole 20 through the connection of the safety fuse tool swivel 18 to a universal connector on the insulated pole 20 and with the safety fuse tool 10 placed into its open position, the safety fuse tool 10 is ready for use as described by the following non-limiting examples. Generally, when a fuse open circuits, i.e., blows, the open circuiting of the fuse generally causes the top end 7 of the fuse barrel assembly 2 to be released from the fuse block switch 8 while the bottom end 5 of the fuse barrel assembly 2 remains seated in the fuse block saddle 9. After this occurs and when the user is ready to replace the blown, the safety fuse tool 10 is positioned so that the carrying arm 42 can be inserted through fuse slot 70; the carrying arm 42 is then inserted through the fuse slot 70 and the safety fuse tool 10 is vibrated or jiggled, or the fuse barrel assembly 2 is slightly lifted from the fuse block saddle 9, in order to automatically set the safety fuse tool 10 into its closed position; thereby, securing the fuse barrel assembly 2 to the safety fuse tool 10 until released. Generally, the securing of the fuse barrel assembly 2 to the safety fuse tool 10 is accomplished by the application of a force generally directed from the top end 27 to the bottom end 29 of the body 28 (a "Downward Force"). This Downward Force causes the head assembly 14 to move down the shaft 22 from the head assembly's 14 open position to the head assembly's 14 closed position while simultaneously causing the latch 16, through the sliding contact between the bottom end 29 of the body 28 with the cam end 52 of each arm 17, to rotate from the latch's 16 open position to the latch's 16 closed position. As shown in FIGS. 2, 4A, 4B, 5A and 5B, in the closed position a cutout portion 53 on each arm 17 engages with the bottom end 29 of the body 28, including the slanted portion 32, and the notch 33, and, when so engaged, the lip 55 on the cutout portion 53 of each arm 17 latches against the vertical portion 35 of the notch 33, which maintains the latch 16 in the closed position until a force directed from the bottom end 29 to the top end 27 of the body 28 (an "Upward Force") is applied to the head assembly 14. Once the fuse barrel assembly 2 has been lifted from the fuse saddle block 9 and transported to the ground, an Upward Force is applied to the head assembly 14 causing the head assembly 14 to separate from the latch 16 freeing the lip 55 from the vertical portion 35 of the notch, which allows the latch 16 to freely rotate toward the latch's 16 open position. Similarly, once the user is ready to install a fuse barrel assembly 2 back into the fuse block 1, the reverse of this process described above is essentially performed. For example, to replace a fuse barrel assembly 2: the carrying arm 42 is inserted through the fuse slot 70; the safety fuse tool 10 is placed in its closed position by applying a Downward Force to the head assembly 14; the safety fuse tool 10 and fuse barrel assembly 2 are lifted and positioned to seat the fuse pivot pins 3 into the saddle slots 4 on the fuse block saddle 9; an Upward Force is then applied to the head assembly 14 to unlatch the safety fuse tool 10, i.e., set the safety fuse tool 10 into its open position; the carrying arm 42 is then removed from the fuse slot 70 and inserted through the fuse ring 6 of the fuse barrel assembly 2; the carrying arm 42 of the safety fuse tool 10 is then used to rotate the fuse barrel assembly 2 so that the top end 7 of the fuse barrel assembly 2 becomes "locked" into the fuse block switch 8 (thereby potentially placing the fuse barrel assembly 2 back into the electrical circuit); and once the fuse barrel assembly 2 is "locked" into the fuse block switch 8 the carrying arm 42 of the safety fuse tool 10 can be removed from the fuse ring 6 and the safety fuse tool 10 can be prepared for further use or storage.

In some instances the top end 7 of the fuse barrel assembly 2 may be still "locked" into or engaged with the fuse block switch 8, this is especially possible for some fuse block design including, but not limited to, those that do not have an automatic blown fuse release mechanism. To remove the fuse barrel assembly 2 under these circumstances, the safety fuse tool 10 is again attached to an insulated pole 20, and either the carrying arm 42 or the hook 40 is inserted through the fuse ring 6. Afterwards, the safety fuse tool 10 is used to apply a pulling force on the top end 7 of the fuse barrel assembly 2 to free the top end 7 of the fuse barrel assembly 2 from the fuse block switch 8. Once the top end 7 of the fuse barrel assembly 2 is free from the fuse block switch 8, and if the bottom end 5 of the fuse barrel assembly 2 is still seated in the fuse block saddle 9, then the safety fuse tool 10 can be removed from the fuse ring 6 and the fuse removal process described above can be used to carry the fuse barrel assembly 2 to the ground. Some fuse blocks 1 and/or fuse barrel assemblies 2, however, are not designed to automatically release the fuse barrel assembly 2 from the fuse block switch 8. When the safety fuse tool 10 is being used to remove fuses from this configuration, the carrying arm 42 is inserted through the fuse ring 6 and the safety fuse tool 10 is set into its closed position so that the fuse barrel assembly 2 of this configuration can be securely lowered to the ground (essentially from the fuse barrel assembly's 2 "locked" position). Furthermore, in the event that the safety fuse tool 10 is accidentally set into its closed position during use, the safety fuse tool 10 can be set into its open position by applying an Upward Force on the hook 40.

While the latch 16 used with the safety fuse tool 10 is preferably comprised of a pair of pivoting, i.e., movable, curved arms 17 other latch arm designs can also be used as well including, but not limited to: at least one movable straight arm; at least one movable angled arm; and at least one straight or angled fixed arm, which may be used in combination with a movable head assembly to form a fuse securing position. Similarly, while the head assembly 14 preferably moves linearly between its open and closed positions, it is also possible to use a rotating or twisting head assembly 14 movement as well. Moreover, other embodiments of the present invention safety fuse tool 10 may incorporate the use of mechanical (and/or other) assistance in order to move from and/or to its open and/or closed positions, preferably through the use of springs or other suitable devices, and the present invention safety fuse tool 10 may also use mechanical (and/or other) assistance to remain set in either its open and/or closed positions, preferably through the use of detent pins, spring loaded stops, or other suitable devices. Additionally, another embodiment of the present invention fuse tool 10 is fabricated so that it is, preferably, permanently attached to an insulated pole 20 that is capable of being extended over a range of lengths.

Another preferred embodiment is shown in FIGS. 6–9B, this embodiment of the safety fuse tool is generally indicated by reference number 100 and includes a base 102, a head assembly 104, and a latch 106. Preferably the safety fuse tool 100 is fabricated from the same materials by using the same methods, and includes many, if not all, of the same features previously described above. Generally, and preferably, the major differences of this embodiment are: the use of a circular shaft 202; restricting movement of the head assembly 104 through the use of a guide pin 306 and guide slot 308; flaring the top end 405 of the shaft 202; and using only one arm 107 for the latch 106. Furthermore, safety fuse tool 100 of this embodiment functions essentially in the same manner as that previously described above; therefore, the various fuse barrel removal and installation procedures described above can be used for this embodiment as well. However, while these are the preferable differences it should be understood that any modification described herein can be incorporated into or used with this embodiment as well as any other embodiment of the present invention safety fuse tool.

It should be noted that the safety fuse tool should only be used by qualified operators obeying all local, state, and federal rules and regulations associated with the use of this tool and/or other similar devices. Finally, it will be apparent to those skilled in the art of fuse tool servicing and maintenance equipment design, (and/or other related fields), that many other modifications and substitutions can be made to the foregoing preferred embodiments without departing from the spirit and scope of the present invention. The preferred embodiments and the best mode of the present invention are described herein. However, it should be understood that the best mode for carrying out the invention hereinafter described is by way of illustration and not by way of limitation. Therefore, it is intended that the scope of the present invention include all of the modifications that incorporate its principal design features, and that the scope and limitations of the present invention are to be determined by the scope of the appended claims and their equivalents.

What is claimed is:

1. A fuse handling tool, comprising:

(a) a head formed to receive a fuse;

(b) a base adapted to be attached to an insulated pole, said head carried by said base, wherein said head is movably carried by said base, said head having a head engaged position and a head disengaged position; and (e) means for securing said fuse to said head.

2. The fuse handling tool as recited in claim 1, wherein said securing means is carried by said base.

3. The fuse handling tool as recited in claim 1, wherein said securing means further comprises an arm, said arm being pivotally secured to said base, said arm having an arm engaged position and an arm disengaged position.

4. The fuse handling tool as recited in claim 3, wherein said securing means has an open position and a closed position, and wherein said securing means moves from said open position to said closed position automatically upon said head receiving said fuse by both said head moving from said head disengaged position to said head engaged position and said arm moving from said arm disengaged position to said arm engaged position.

5. The fuse handling tool as recited in claim 1, wherein said securing means has an open position and a closed position.

6. The fuse handling tool as recited in claim 1, wherein said head is slidably carried by said base.

7. The fuse handling tool as recited in claim 1, wherein said securing means has an open position and a closed position and wherein, when said fuse is received by said head, said securing means automatically moves from said open position to said closed position.

8. A fuse handling tool, comprising:

(a) a base having a base top end and a base bottom end;

(b) a head carried by said base having a head top end and an opposing head bottom end, said head adapted to carry a fuse; and (c) means mounted to said base for securing said fuse to said head, wherein said fuse securing means automatically secures said fuse to said head member.

9. The fuse handling tool as recited in claim 8, wherein said base has a rod extending from said top end, and wherein said head has a passage from said head top end to said head bottom end formed therethrough, said passage adapted to receive said rod so that said head is slidably carried by said base.

10. The fuse handling tool as recited in claim 8, wherein said fuse securing means further comprises at least one securing arm having a first end and an opposing second end and being pivotally mounted to said base, wherein said at least one securing arm is pivotal about a pivot point on said base, and wherein said first end is proximal to said pivot point and said second end is distal from said pivot point.

11. The fuse handling tool as recited in claim 8, wherein said head further comprises at least one fuse carrying arm extending from said head, said at least one fuse carrying arm being at least about 2.5 inches in length.

12. The fuse handling tool as recited in claim 8, wherein said fuse securing means further comprises a latch pivotally mounted to said base, said latch having a pivot point and having a latched position and an unlatched position, said latch having a first latch end and an opposing second latch end, said first latch end being proximal to said pivot point and said second latch end being distal from said pivot point, and wherein said head has a first position and a second position, and wherein said first latch end holds said head in said first position when said latch is in said unlatched position, and wherein the movement of said head into said second position causes said latch to rotate into said latched position.

13. The fuse handling tool as recited in claim 10, wherein said securing means has an open position and a closed position, and wherein said bottom end of said head and each said first end of each said at least one securing arm are adapted for positioning said securing means into and between said open position and said closed position.

14. The fuse handling tool as recited in claim 13, wherein said bottom end of said head has a notch, and wherein each said first end of each said at least one securing arm has a lip that is adapted to engage said notch for retaining said securing means in said closed position.

15. A fuse handling tool, comprising:

(a) a base having a base top end and a base bottom end;

(b) a head carried by said base adapted to carry a fuse from a fuse block, said head having a head top end and an opposing head bottom end, said head having a head body, said head having a first position and a second position; and (c) a latch attached to said base adapted to engage said head for securing said fuse to said head, said latch having a first latch end and an opposing second latch end, said latch having a latched position and an unlatched position.

16. The fuse handling tool as recited in claim 15, wherein said base has a rod extending from said base top end, and wherein said head has a passage formed therethrough from said head top end to said head bottom end, said passage adapted to receive said rod so that said head is slidably carried by said base.

17. The fuse handling tool as recited in claim 15, further comprising:

(a) a means for guiding said head from and to said first position and said second position; and (b) a means for pivotally mounting said latch to said base.

18. The fuse handling tool as recited in claim 15, wherein said head further comprises at least one arm extending from said head body, each said at least one arm having an attached end and a free end, each said attached end being attached to said head body and each said free end extending away from said head body.

19. The fuse handling tool as recited in claim 15, wherein said head further comprises an inclined portion and a notch formed thereon, said notch formed between said head bottom end and said head top end, said inclined portion sloping from said head bottom end to said notch, and wherein said first latch end is formed to have an incline follower surface and a locking surface, wherein said head inclined portion is in contact with said incline follower surface when said head is in said first position and said latch is in said unlatched position, and wherein the application of a force causing said head to move from said first position to said second position also causes said latch to rotate from said unlatched position to said latched position, wherein causing said locking surface and said notch to become engaged.

20. The fuse handling tool as recited in claim 18, wherein said free end of one of said at least one arm is adapted for being inserted through a fuse ring, applying a force to said fuse ring for releasing said fuse from said fuse block, and receiving said fuse, wherein, after said fuse is released from said fuse block and received by said one of said at least one arm, said head automatically moves from said first position to said second position causing said latch to rotate from said unlatched position to said latched position, wherein the second latch end and said free end of said at least one arm are positioned to secure said fuse to said one of said at least one arm.

* * * * *